US007036192B2

(12) United States Patent
Yoneoka

(10) Patent No.: US 7,036,192 B2
(45) Date of Patent: May 2, 2006

(54) SEPARABLE END STOP FOR SLIDE FASTENERS

(75) Inventor: Morimasa Yoneoka, Toyama-ken (JP)

(73) Assignee: YKK Corporation, Tokyo (JP)

( * ) Notice: Subject to any disclaimer, the term of this patent is extended or adjusted under 35 U.S.C. 154(b) by 102 days.

(21) Appl. No.: 10/775,984

(22) Filed: Feb. 9, 2004

(65) Prior Publication Data

US 2005/0050699 A1 Mar. 10, 2005

(30) Foreign Application Priority Data

Feb. 19, 2003 (JP) ..... 2003-041185

(51) Int. Cl.
*A44B 1/04* (2006.01)

(52) U.S. Cl. ..... 24/443; 24/303

(58) Field of Classification Search ..... 24/443, 24/381, 437, 303, 90.1, 433, 434, 435, 390, 24/389, 388
See application file for complete search history.

(56) References Cited

U.S. PATENT DOCUMENTS

| | | | | |
|---|---|---|---|---|
| 3,583,041 A | | 6/1971 | Horwitt | |
| 3,775,812 A | | 12/1973 | Carver | |
| 4,139,927 A | * | 2/1979 | Heimberger | 24/434 |
| 4,231,137 A | * | 11/1980 | Fujimoto | 24/303 |
| 4,232,429 A | | 11/1980 | Friedberg | |
| RE31,487 E | * | 1/1984 | Friedberg | 24/386 |
| 4,979,702 A | * | 12/1990 | Franklin | 244/129.4 |
| 5,125,134 A | * | 6/1992 | Morita | 24/303 |
| 5,953,795 A | * | 9/1999 | Bauer | 24/303 |
| 6,026,547 A | * | 2/2000 | O'Donnell | 24/433 |
| 6,088,888 A | * | 7/2000 | Oda | 24/433 |
| 6,292,985 B1 | * | 9/2001 | Grunberger | 24/303 |
| 6,421,887 B1 | * | 7/2002 | Oda et al. | 24/433 |

FOREIGN PATENT DOCUMENTS

| | | |
|---|---|---|
| FR | 2700672 | 7/1994 |
| JP | 2000-232908 | 8/2000 |

* cited by examiner

*Primary Examiner*—J J Swann
*Assistant Examiner*—Mark T. Vogelbacker
(74) *Attorney, Agent, or Firm*—Everest Intellectual Property Law Group; Michael S. Leonard

(57) ABSTRACT

Separable end stop comprises a retaining member and an insert member both made of synthetic resin, mounted on the lower ends of the fastener stringers, and adapted to come into and out of engagement with each other in the general plane of a slide fastener. The retaining member and the insert member have a first and a second rotary plate integrally provided on their respective lower ends and adapted for mutual rotation relative to each other to thus swing the retaining member and the insert member relative to each other. The first and second plates have a first and a second magnetic element provided thereon, respectively, for magnetically putting the rotation plates into proper positions for the mutual rotation upon each other.

2 Claims, 16 Drawing Sheets

SEPARABLE END STOP FOR SLIDE FASTENERS

CROSS-REFERENCE TO RELATED APPLICATIONS

Not applicable.

BACKGROUND OF THE INVENTION

1. Field of the Invention

This invention relates to a separable end stop for a slide fastener, and particularly to a separable end stop of the so-called side-open type which is comprised of a retaining member adapted for retaining a slider in open disposition of the slide fastener and an insert member adapted to be inserted into the retaining member. The retaining member and the insert member are adapted to come to contact with each other from the front and the rear of the general plane of the slider and then rotate upon each other, thereby bringing the retaining member and the insert member into abutting relation laterally of the slide fastener, so that two fastener stringers becomes ready for being introduced into a slider.

2. Description of the Related Art

Heretofore, there has been known a so-called "side open type" separable end stop wherein two separable end stop members, that is, a retaining member and an insert member are adapted to be joined and separated laterally of the slide fastener. One typical example of this type separable end stop is disclosed in U.S. Pat. No. 4,139,927. As shown in FIG. 25 of the drawings appended hereto, the retaining member 112 and the insert member 110 of the separable end stop 100 are mounted on the lower ends of the left and right fastener stringers 102, 104, respectively. A pin 108 is press-fitted into a socket 106 and then the insert member 110 is swung relative to the retaining member 112 laterally of the slide fastener. This would bring the insert member 110 into abutting engagement with the retaining member 112, and hence bring the fastener stringer 102 into abutting relation to the other fastener stringer 104. Then, an upward movement of the slider 114 along the abutted fastener stringers 102, 104 would close the slide fastener.

Furthermore, another separable end stop of this type is shown in Japanese Patent Laid-open Application No. 2000-232908 and reproduced here in FIG. 26 of the appended drawings. The separable end stop 200 is comprised of two separable end stop members; namely, a first end stop member 202 mounted on the lower end of one fastener stringer 206 of a slide fastener and a second end stop member 204 mounted on the lower end of the other fastener stringer 208 of the same slide fastener. The first end stop member 202 comprises a retaining member 210 having a groove 214 formed on its side and a male engaging portion or projection 216 provided at the lower end of the retaining member 210. The male engaging portion 216 includes a circular base 218 and a snap-type projection 220 mounted centrally on the lower side of the circular base 218. The second end stop member 204 comprises an insert member 212 adapted to be inserted into the groove 214 of the retaining member 210 and a female engaging member 222 provided at the lower end of the insert member 212. The female engaging member 222 includes a circular base 224 and a snap-type hole 226 formed centrally on the base 224.

With the construction, the snap-type projection 220 of the male engaging portion 216 is brought into snapping engagement with the snap-type hole 226 of the female engaging portion 222, and then the second end stop member 204 is swung relative to the first end stop member 202 laterally of the slide fastener to thus insert the insert member 212 into the groove 214 of the first end stop member 202, and then a slider (not shown) is moved upward so that the slide fastener is closed.

In the separable end stops disclosed in U.S. Pat. No. 4,139,927 and Japanese Patent Laid-open Application No. 2000-232908, the engaging members such as the pin 108 and the socket 106 or the projection 220 and the hole 226 are provided at the end of the slide fasteners and are all disposed perpendicularly of the general plane of the slide fasteners. So, in order to join the both fastener stringers 102, 104; 206, 208 of the slide fastener; first one has to position the pin 108 and the socket 106 (or the projection 220 and the hole 226) into registry or proper relative position with each other, and then press-fit the pin 102 or the projection 106 into the socket 104 or the hole 208. Therefore, these conventional devices encounter a problem that the operation of placing the engaging members into the proper relative position and engaging the engagement members is very tedious, and difficult particularly for children and aged persons.

It is a principal object of the present invention to provide a separable end stop wherein the aforementioned disadvantages are obviated.

Another object of the present invention is to provide a separable end stop wherein the operation of placing the engaging members into the proper relative position and engaging the engagement members is so easy that even children and aged persons can manipulate the separable end stop with great ease.

Further objects and advantages of the invention will become apparent from a consideration of the drawings and ensuing description.

SUMMARY

According to the present invention, there is provided, in a slide fastener comprising a pair of opposed pair of fastener stringers and a slider reciprocally mounted on the fastener stringers to open and close the fastener stringers; a separable end stop comprising a retaining member and an insert member mounted on the lower ends of the fastener stringers and adapted to come into and out of engagement with each other in plane of the slide fastener. The retaining member and the insert member have a first and a second rotary plate integrally provided on their respective lower ends and adapted for mutual rotation relative to each other to thus swing the retaining member and the insert member relative to each other. The first and second plates have a first and a second magnetic element provided thereon, respectively, for magnetically putting the rotary plates into proper positions for the mutual rotation relative to each other.

DETAILED DESCRIPTION OF THE INVENTION

Figure 1:
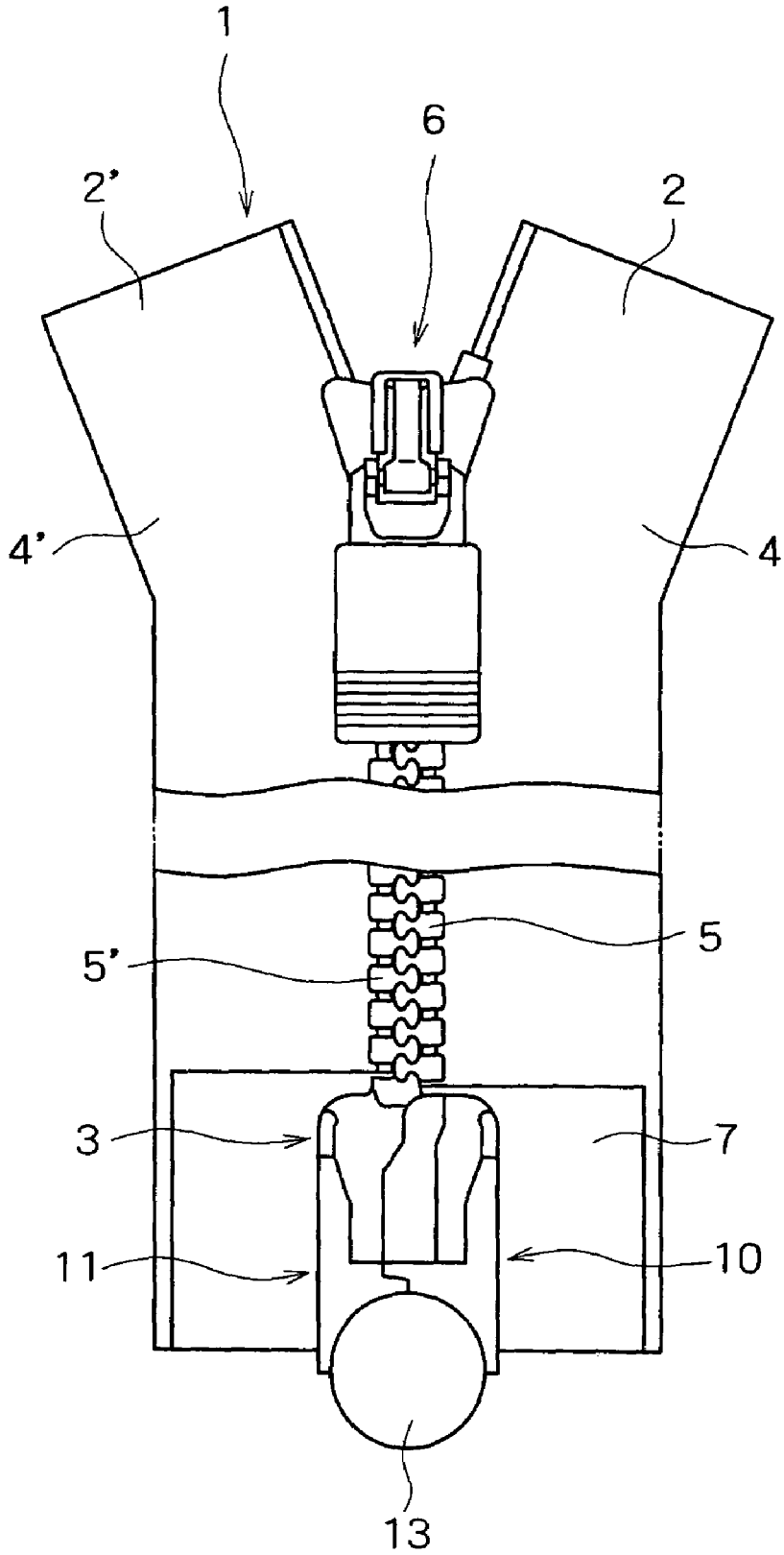
FIG. 1 is a front view of a slide fastener provided with a side-open type separable end stop according to the first embodiment of the present invention.

The following provides a list of the primary reference characters used in the drawing:

10 Retaining member
11 Insert member
12 First rotary plate (of Retaining member)
13 Second rotary plate (of Insert member)
14 First surface (of Retaining member)
15 Second surface (of insert member)
17 First magnetic elements
17' Second magnetic elements
18 First magnets
18' Second magnets
19 Magnetic sheet
20 Magnetic paint or varnish
25 Projection
26 Hole
27 Peripheral wall
28, 28' Recess
29, 29' Inwardly projecting rim
32 Cutout portion Detailed description of the present invention is made below in respect of embodiments of a separable end stop for slide fasteners in conjunction with the drawings attached hereto.

Figure 8:
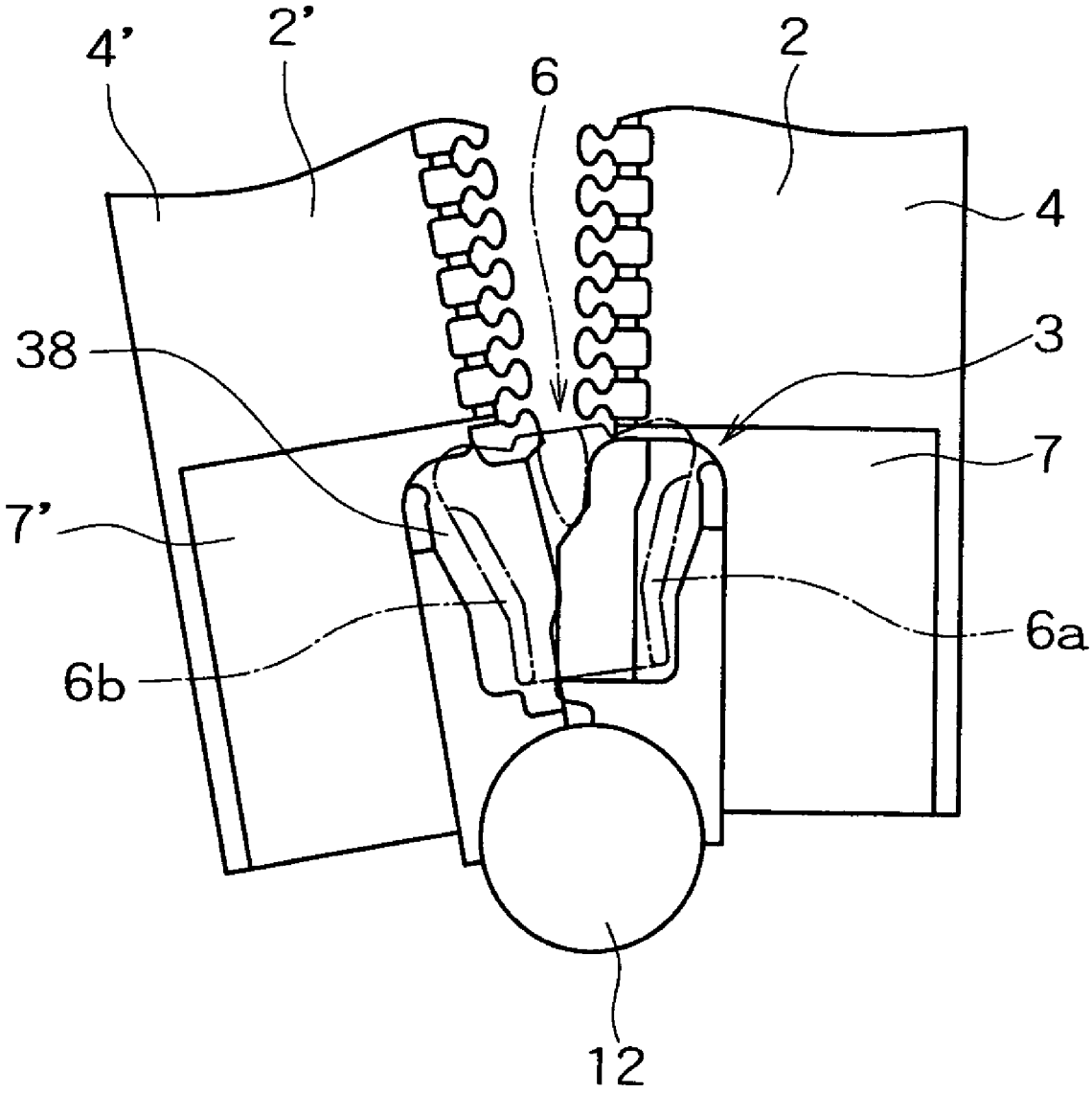
FIG. 8 is a fragmentary front view of the slide fastener immediately before the slide fastener is completely closed.

FIG. 1 shows a slide fastener 1 comprising a pair of opposed fastener stringers 2, 2'. Each stringer 2, 2' includes a fastener tape 4, 4' and a row of fastener elements 5, 5' of various types (in this case, discrete type) mounted on the inner longitudinal edge of the fastener tapes 4, 4'. A slider 6 is mounted on the two fastener element rows 5, 5' so as to reciprocate therealong so as to couple and decouple the fastener element rows 5, 5' to thus open and close the slide fastener 1. The slider 6 is comprised of a pair of upper and lower wings joined at their front ends by a diamond or a guide post. As shown in FIG. 8, the upper and lower wings have two pair flanges 6*a*, 6*b* formed on both sides thereof, each pair being comprised of an upper and lower flanges from the respective sides of the upper and lower wings extending toward each other to define therebeween a space through which the fastener tapes 4, 4' pass.

FIG. 1 also shows a separable end stop 3 according to the first embodiment of the present invention attached to the lower end of the slide fastener 1. As better shown in FIG. 2, the separable end stop 3 is comprised of a slider-retaining member 10 which is mounted on the lower end of one fastener stringer 2 and which is adapted to retain a slider 6 thereon when the slide fastener 1 is in open disposition; and an insert member 11 which is mounted on the lower end of the other fastener stringer 2'. The retaining member 10 and the insert member 11 have a first and second circular rotary plates 12, 13 formed integrally with the lower ends of the retaining member 10 and the insert member 11, respectively, and which are adapted to come into overlapping engagement with each other perpendicularly of the general plate of the slide fastener. The circular rotary plates 12, 13 have a first and a second surface 14, 15 formed on their respective confronting sides and a first and a second magnetic element 17, 17' provided on the first and second rotary plates 12, 13, so that the first and second surfaces 14, 15 magnetically attract each other. Then, the first and second circular rotary plates 12, 13 can be rotated relative to each other through a predetermined angle.

Figure 2:
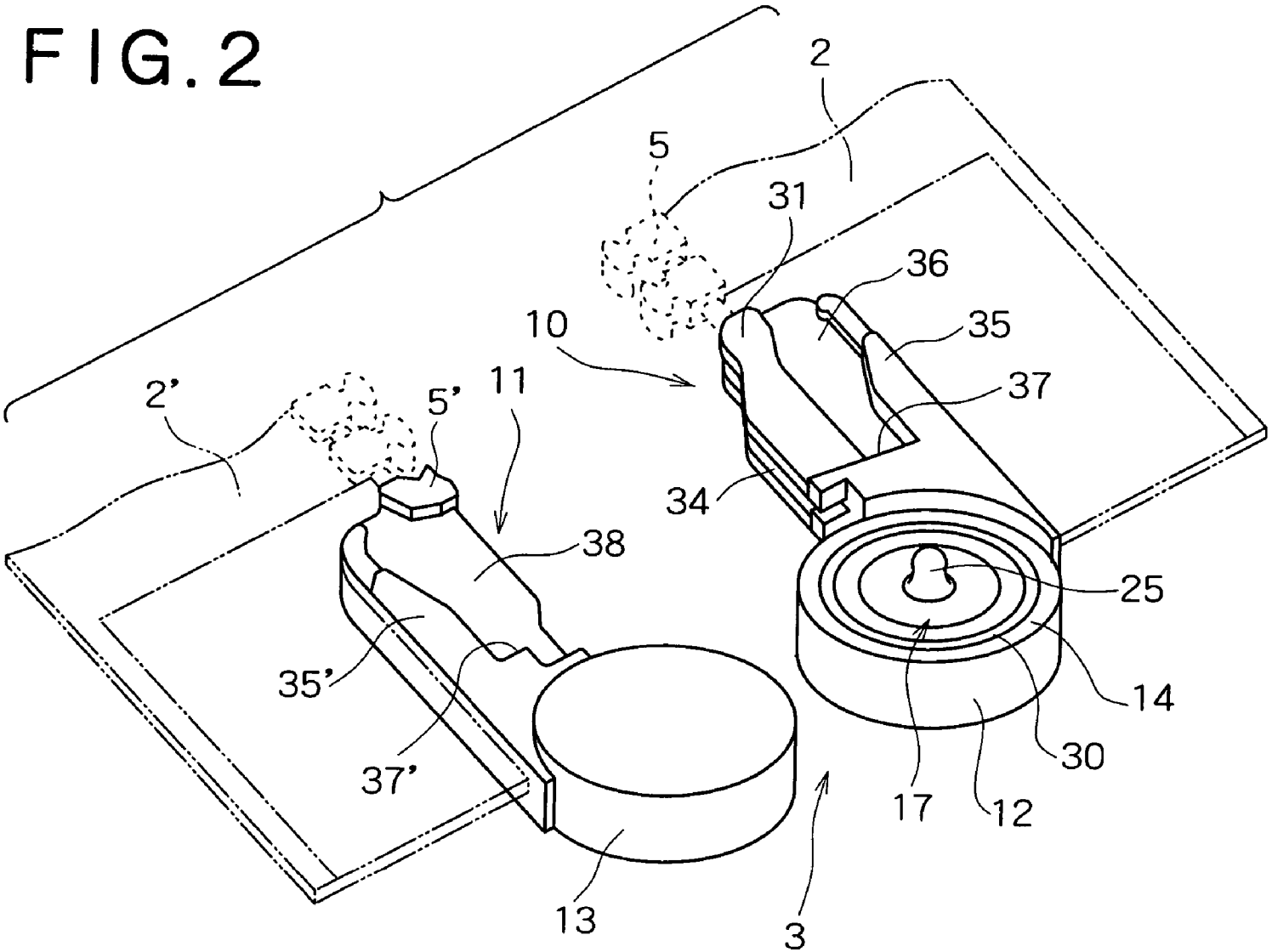
FIG. 2 is a perspective view of a retaining member and an insert member of the separable end stop of FIG. 1, when the left and right fastener stringers of the slide fastener are separated.

As shown in FIGS. 1 and 2, each of the fastener stringers 2, 2' has reinforcing tapes 7, 7' made of thermoplastic film attached to their respective lower end. The retaining member 10 and the insert member 11 are made of thermoplastic resin such as polyamide, polyacetal, polypropylene, polybuthlene terephthalate or thermosetting plastics such as urea resin, melamine resin. In order to provide the separable end stop 3 at the end of the slide fastener 1, as shown in FIG. 2, the retaining member 10 and the insert member 11 are mounted integrally on the reinforcing tapes 7, 7' of the fastener stringers 2, 2', respectively, through injection molding process.

Figure 3:
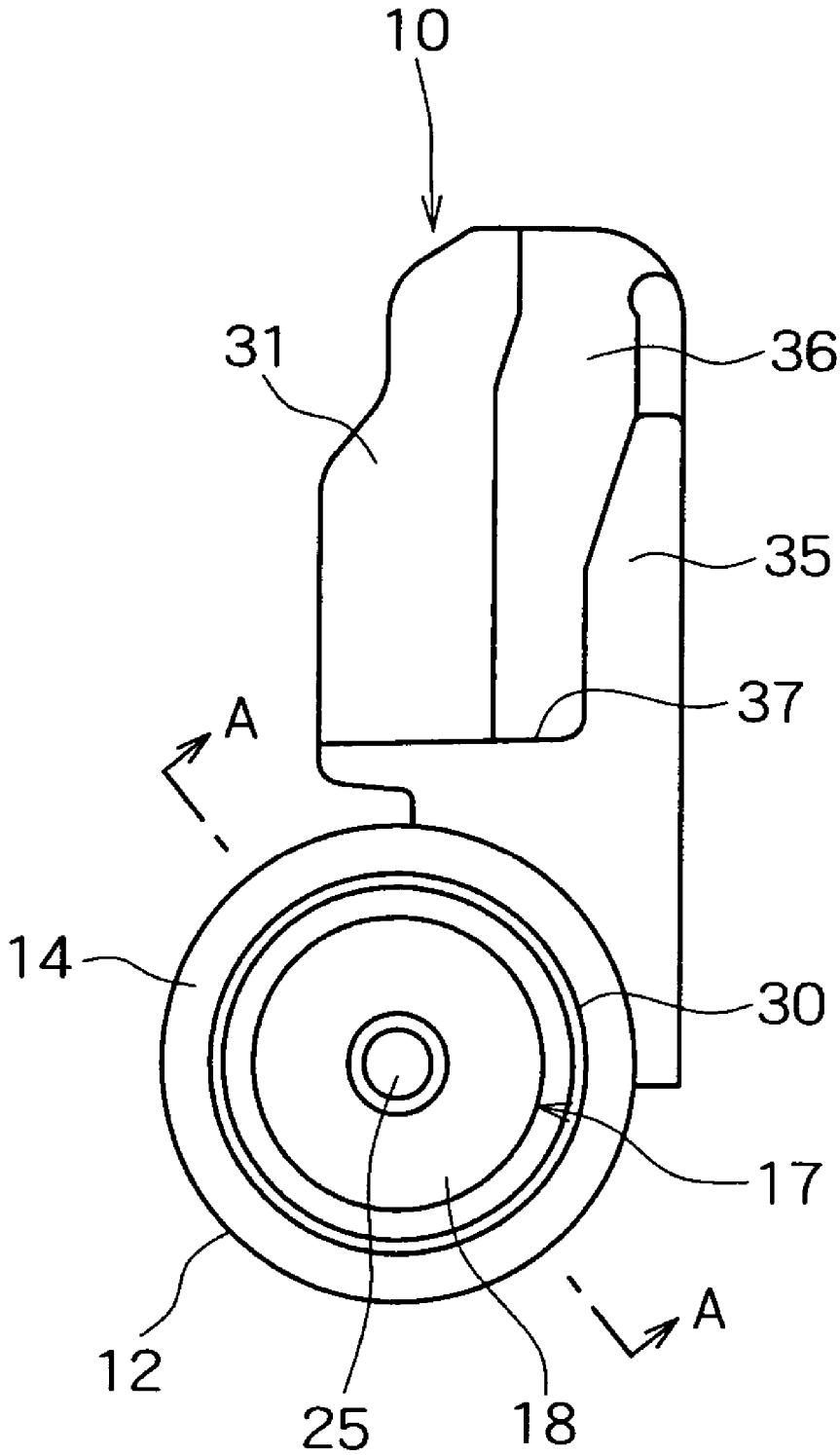
FIG. 3 is a front view of the retaining member of FIG. 2.
Figure 5:
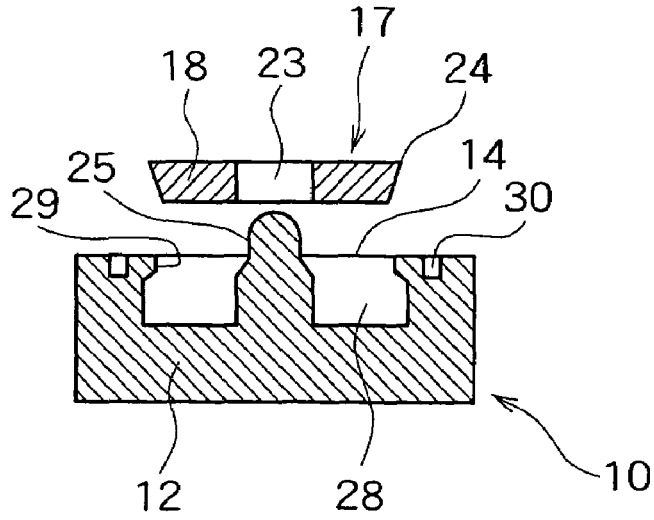
FIG. 5 is a cross-sectional view taken on line A—A of FIG. 3.

As shown in FIG. 3, the retaining member 10 has the first circular rotary plate 12 formed integrally at the lower end thereof. The first rotary plate 12 has the first magnet 18 as the first magnetic element 17 provided on the first surface 12. As shown in FIGS. 3 and 5, the first rotary plate 12 has a projection 25 mounted centrally thereof and a first annular recess 28 formed therein around the projection 25. The first magnet 18 is press-fitted to and retained in the first annular recess 28. As shown in FIG. 5, the first rotary plate 12 has an inwardly projecting peripheral rim 29 formed on the outer peripheral edge of the first annular recess 28. A shallow annular slit 30 is formed on the surface 14 co-axially and outwardly of the first annual recess 28 to thus facilitate the removal of one of the two complementary mold parts from the other after the injection-molding of the retaining member 10.

As shown in FIG. 5, the first magnet 18 to be press-fitted into the first annular recess 28 is like an annular plate. The first annular magnet 18 has a through aperture 23 formed centrally thereof to let the projection 25 pass therethrough. The first annular magnet 18 is tapered downwards (as viewed in FIG. 5) in its periphery in such a manner that the annular magnet 18 is made smaller in the diameter of its lower side and slightly larger in the diameter of its upper side than the inner diameter of the inwardly-projecting peripheral rim 29 of the recess 28. The first annular magnet 18 has an engaging rim 24 with an acute angle cross-section formed on its upper periphery. With the construction, forcing the first annular magnet 18 into the first annular recess 28 against the resiliency of the inwardly projecting rim 29 causes the projecting rim 29 spring back against the engaging rim 24, so that the first annular magnet 18 is resilient retained within the first annular recess 28.

As shown in FIG. 3, the retaining member 10 has a thickened retaining bar 31 provided on the inner side thereof. When the slider 6 is moved down to the bottom, the slider 6 becomes retained by the retaining bar 31. The retaining bar 31 has a longitudinal slot 34 formed in its inner side into which an insert plate 38 of the insert member 11 can be inserted. The retaining member 10 has a thickened retaining side wall 35 provided on the outer side thereof. The inner edge of the retaining sidewall 35 is substantially identical with the outline of the side of the slider 6. The retaining bar 31 and the retaining sidewall 35 defines therebetween a guide groove 36 into which the side flanges of the slider 6 can be inserted into. At the lower end of the retaining sidewall 35, a lower stop wall 37 is provided to stop the downward movement of the slider 6. The stop wall 37 is substantially as thick as the retaining side wall 35.

Figure 4:
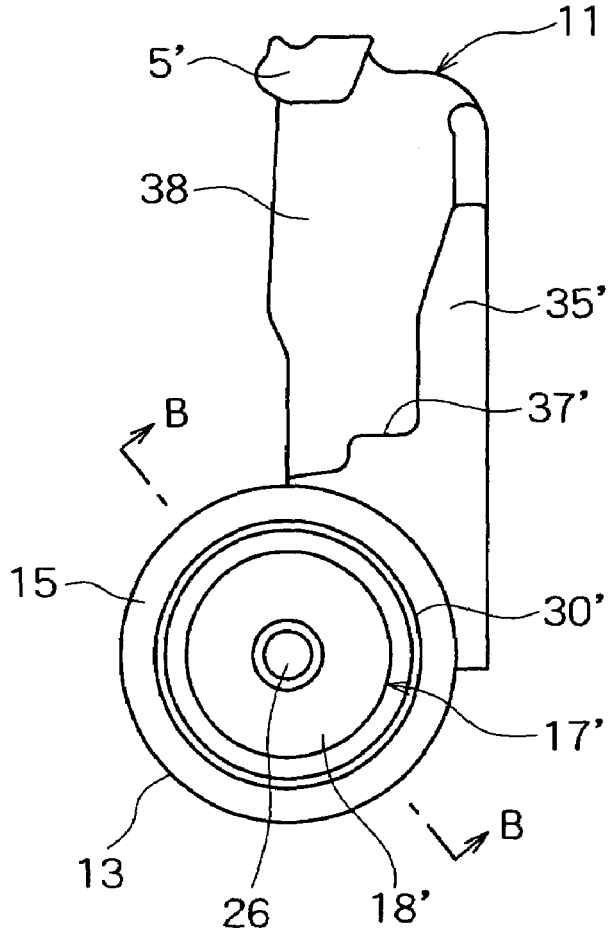
FIG. 4 is a rear view of the insert member of FIG. 2.
Figure 6:
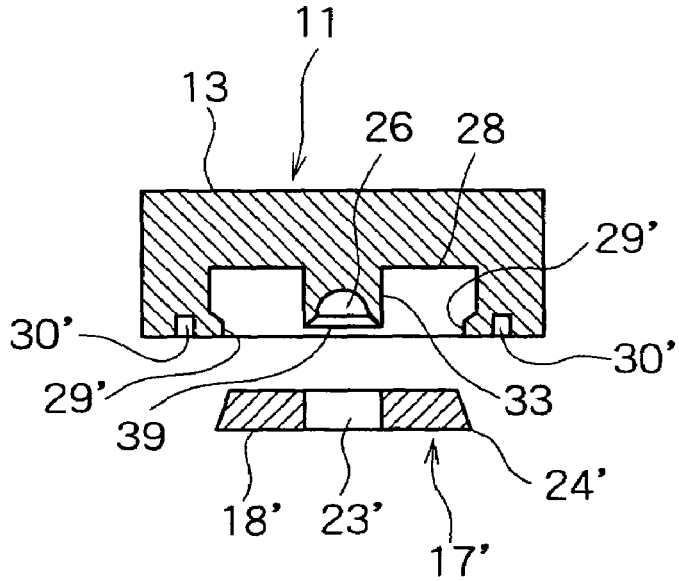
FIG. 6 is a cross-sectional view taken on line B—B of FIG. 4.

As shown in FIG. 4, the insert member 11 has a circular second rotary plate 13 formed integrally at the lower end thereof. The rotary plate 13 has a second magnet 18, as a second magnetic element 17' provided on the second surface 15. As shown in FIGS. 4 and 6, the rotary plate 13 has a protuberant post 33 mounted centrally thereof. The protuberant post 33 has a hole 26 formed in its top for fining engagement with the projection 25 of the retaining member 10. The protuberant post 33 has a chamfer 39 formed on the peripheral edge of the hole 26 to facilitate guidance of the projection 25 into the fining hole 26. The rotary plate 13 has a second annular recess 28' formed around the protuberant post 33. As in the case of the retaining member 10, an inwardly-projecting peripheral rim 29' is provided on the outer peripheral edge of the second annular recess 28' so as to retain the second magnet 18' therein. A shallow annular slit 30' is formed on the second surface 15 coaxially and outwardly of the second annual recess 28.

As shown in FIG. 6, the second magnet 18' to be press-fitted into the second annular recess 28' is like an annular plate, as the first magnet 18 for the retaining member 10. The second annular magnet 18' has a through aperture 23' formed centrally thereof to let the protuberant post 33 pass therethrough. The second annular magnet 18' is tapered upward (as viewed in FIG. 6) in its periphery in such a manner that the annular magnet 18' is made smaller in the diameter of its upper side and slightly larger in the diameter of its lower side than the inner diameter of the inwardly-projecting peripheral rim 29'. The second annular magnet 18' has an engaging rim 24' with acute angle cross-section formed on the lower periphery. With the construction, forcing the second annular magnet 18' into the second annular recess 28' against the resiliency of the inwardly projecting rim 29' causes the projecting rim 29' spring back against the engaging rim 24, so that the second annular magnet 18' is resiliently retained within the second annular recess 28'.

As shown in FIG. 4, the insert member 11 has an insert blade 38 which is thin enough to be inserted into the slot 34 of the retaining member 10 and also between the upper and lower flanges of the slider 6. The insert member 11 has a thickened retaining side wall 35' provided on the outer side of the insert blade 38. The inside edge of the thickened retaining wall 35' is substantially identical with the outline of the side of the slider 6. At the lower end of the retaining sidewall 35', a lower stop wall 37' is provided to stop the downward movement of the slider 6. The lower stop wall 37' is substantially as thick as the retaining side wall 35'.

Now, turning to the description of the operation of the separable end stop 3 according to the first embodiment of the present invention.

A pair of fastener stringers 2, 2' are separated, with the slider 6 retained on the retaining bar 31 of the retaining member 10 of one of the fastener stringers. As, in this disposition, the retaining member 10 and the insert member 11 are brought closer to each other with the first and second surfaces 14, 15 confronting with each other, the magnets 18, 18' installed in the first and second rotary plates 12, 13 magnetically attracts each other, so that the projection 25 is fitted into the fitting hole 26, whereupon the first and second surfaces 14, 15 contact each other, in other words, the first and second rotary plates 12, 13 come into proper positions for mutual rotation upon each other, as shown in FIG. 7.

Figure 7:
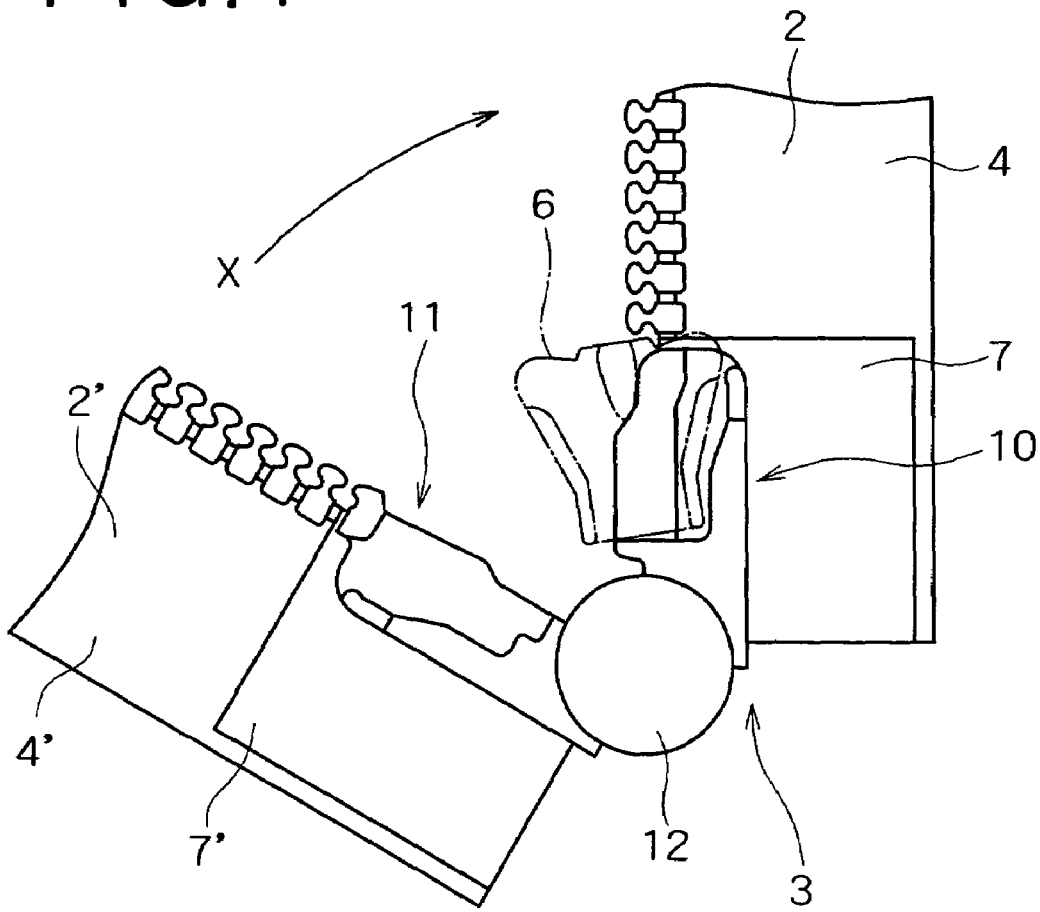
FIG. 7 is a fragmentary front view of the slide fastener in open state.

After the rotary plates 12, 13 come into proper position for mutual rotation, the insert member 11 is swung relative to the retaining member 10 through rotation of the first and second rotary plates 12, 13 in the direction indicated by arrow X in FIG. 7. As a result, the insert member 11 comes to the position shown in FIG. 8, wherein the insert blade 38 are between the flanges **6*b* of the slider 6 retained in the retaining member 10 and are about to come into the slot 34 of the retaining bar 31. After the fastener stringer 2' provided with the insert member 11 is swung into the slider 6, the slider 6 is then pulled up along the fastener element rows 5, 5', so that the fastener element rows 5, 5' are coupled together and the left and right fastener stringers 2, 2' are completely closed, as shown in FIG. 1**.

In order to open the slide fastener 1 in closed state as shown in FIG. 1, first the slider 6 is pulled down until the slider 6 comes into abutting engagement with the stop walls 37, 37'. Then, the insert member 11 is swung apart from the retaining member 10 to thus bring the insert blade 38 out of the slot 34 of the retaining member 10 and then the slider 6. After the insert blade 38 come completely out of the retaining member 10 and the slider 6, then, the second rotary plate 13 of the insert member 11 is separated from the first rotary plate 12 of the retaining member 10 against the magnetic forces of the magnets 18, 18', so that the fastener stringers 2, 2' are fully separated.

In order that the first and second rotary plates 12, 13 of the retaining member 10 and the insert member 11 attract each other accurately by means of the first and second magnets 18, 18'; the first and second magnets 18. 18' must be arranged in such suitable positions that the first and second magnets 18, 18' can attract each other greatly when the retaining member 10 and the insert member 11 are brought closer to each other. In some cases, the first and second magnets 18, 18' may be arranged such that when the first and second rotary plates 12, 13 are rotated into predetermined relative positions where the rotary plates 12, 13 should be separated, the first and second magnets 18, 18' repel each other, so that the first and second rotary plates 12, 13 can be automatically separated.

Turning to a separable end stop according to the second embodiment shown in FIGS. 9 through 13. The second embodiment is substantially identical with the first embodiment with the exception of the shape of the first and second rotary plates 12, 13 integrally formed with the lower ends of the retaining member 10 and the insert member 11, respectively.

Figure 9:
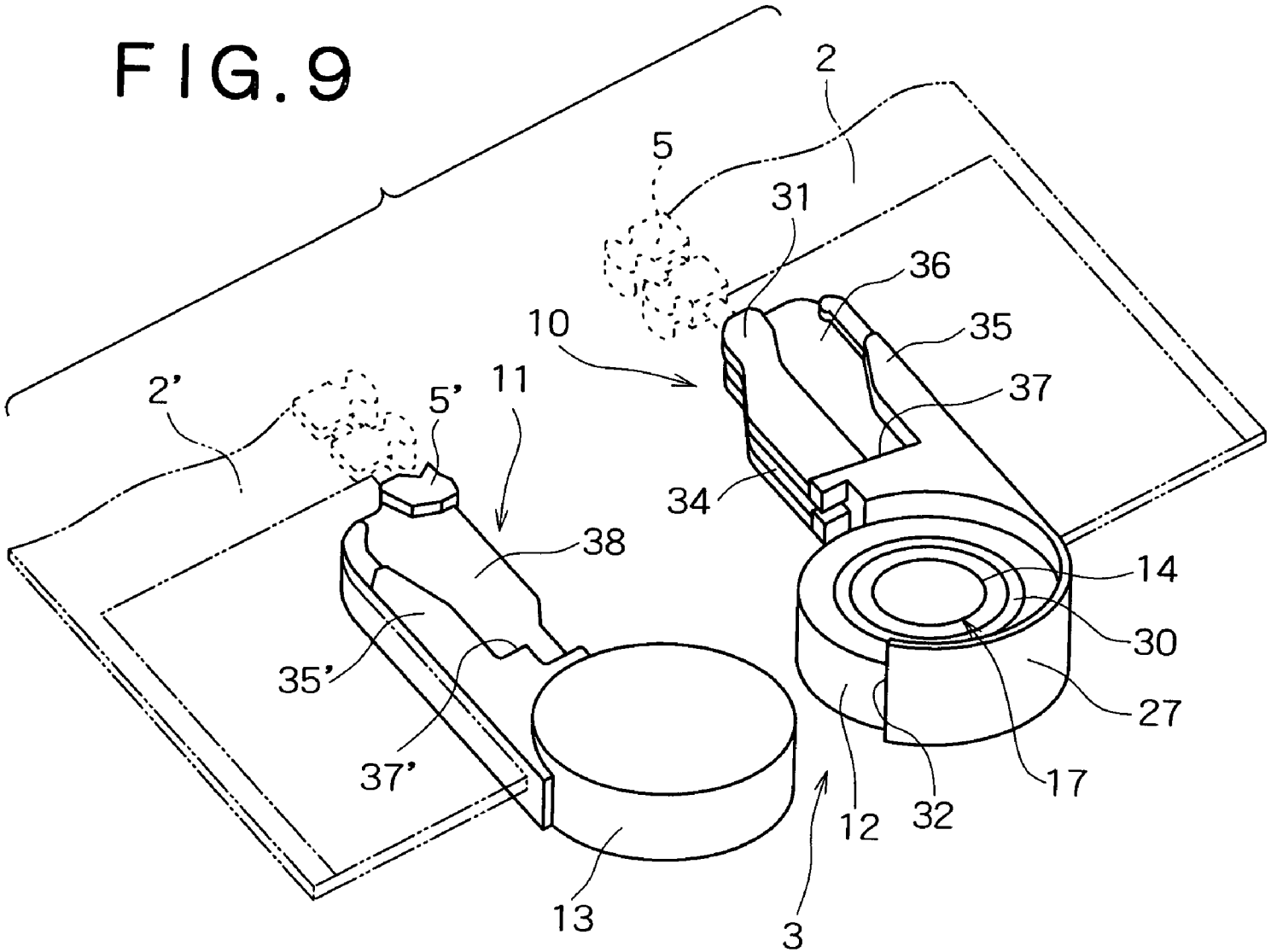
FIG. 9 is a perspective view showing a retaining member and an insert member of a separable end stop according to the second embodiment of the present invention, when the left and right fastener stringers are in separated disposition.
Figure 10:
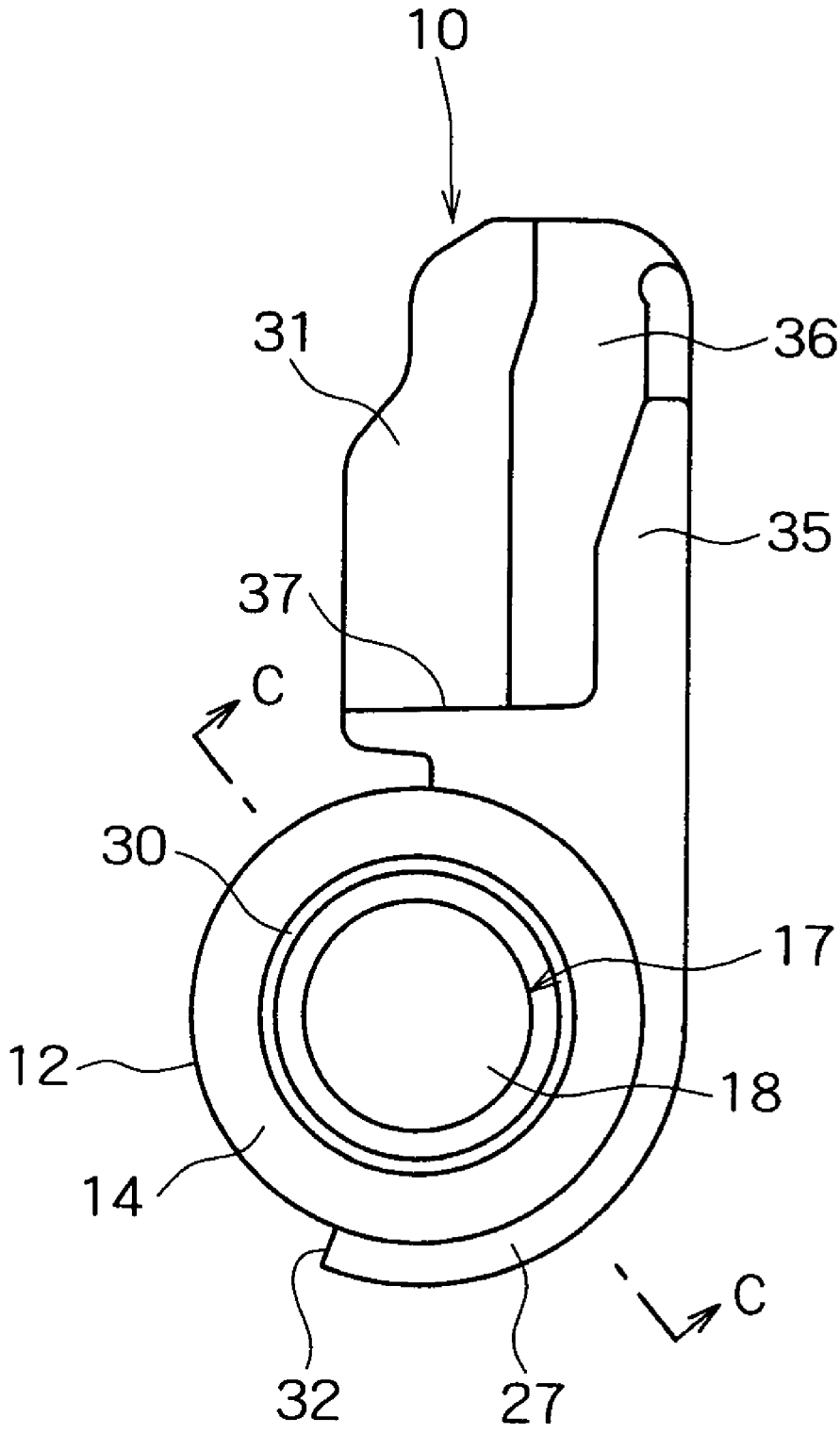
FIG. 10 is a front view of the retaining member of FIG. 9.
Figure 12:
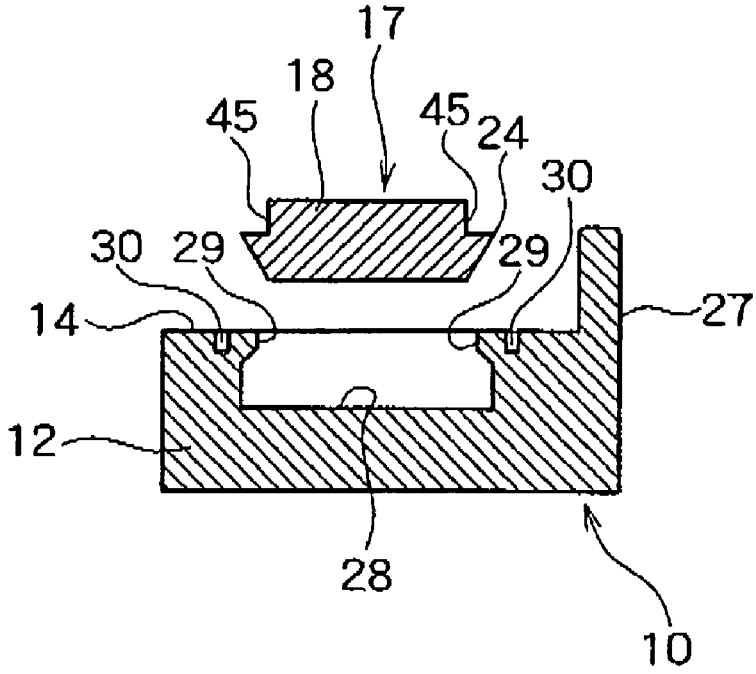
FIG. 12 is a cross-sectional view taken on line C—C of FIG. 10.

As shown in FIGS. 9 and 10, the first rotary plate 12 integrally formed with the lower end of the retaining member 10 has a peripheral wall 27 provided partly around the periphery of the first rotary plate 12. The peripheral wall 27 extends upwards (as viewed in FIG. 9) beyond the first surface 14 of the first rotary plate 12. The peripheral wall 27 of the first rotary plate 12 is adapted to fit to the periphery of the second rotary plate 13 of the insert member 11. The peripheral wall 27 is cut out in the confronting side of the first rotary plate 12 to thus provide a cutout portion 32. The cutout portion 32 permits the first and second rotary plates 12, 13 of the retaining member 10 and the insert member 11 to rotate upon each other, thereby bringing the insert member 11 and the retaining member 10 into and out of engagement with each other. As shown in FIGS. 10 and 12, the first rotary plate 12 has a first circular recess 28 formed centrally on the first surface 14 to accommodate a first circular magnet 18 as a first magnetic element 17 therein. The first rotary plate 12 has an inwardly projecting peripheral rim 29 provided on the outer peripheral edge of the circular recess 28. A shallow annular slit 30 is formed on the first surface 14 coaxially and outwardly of the first circular recess 28 as in the preceding embodiment. The first magnet 18 to be press-fitted into the first circular recess 28 is disk-shaped and has a peripheral step 45 formed around the periphery thereof. The first magnet 18 has an acute-cross-sectioned engaging rim 24 formed therearound. The acute-cross-sectioned engaging rim 24 is tapered downwards (as viewed in FIG. 12) to make it possible that the first circular magnet 17 be snapped into the first circular recess 28 and to ensure that the first circular magnet 17 is firmly retained in the first circular recess 28. An upper small-diameter portion of the first magnet 18 having the step 45 around the periphery thereof is constructed so as to be retained stably by and between the inwardly projecting rim 29.

Figure 11:
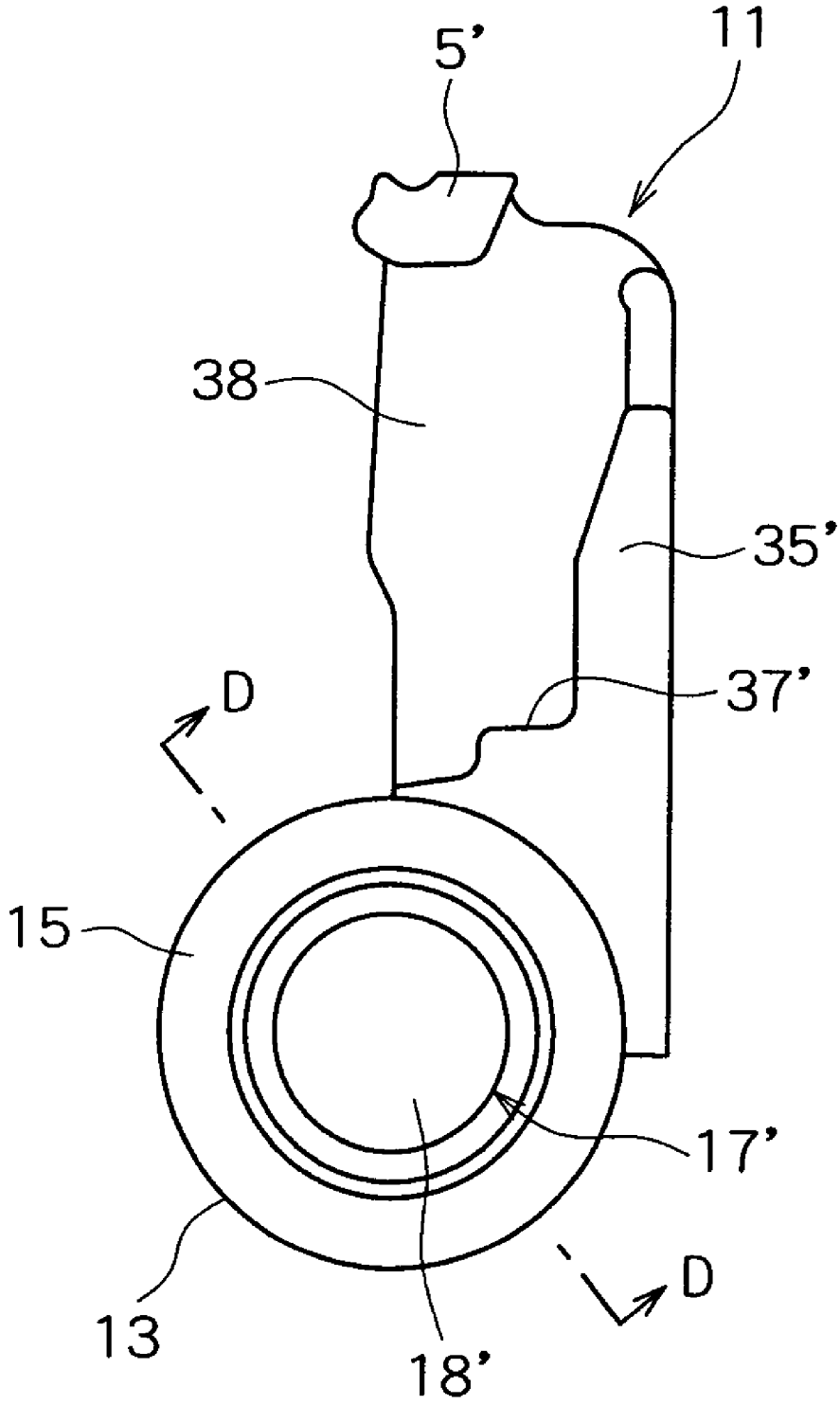
FIG. 11 is a front view of the insert member of FIG. 9.
Figure 13:
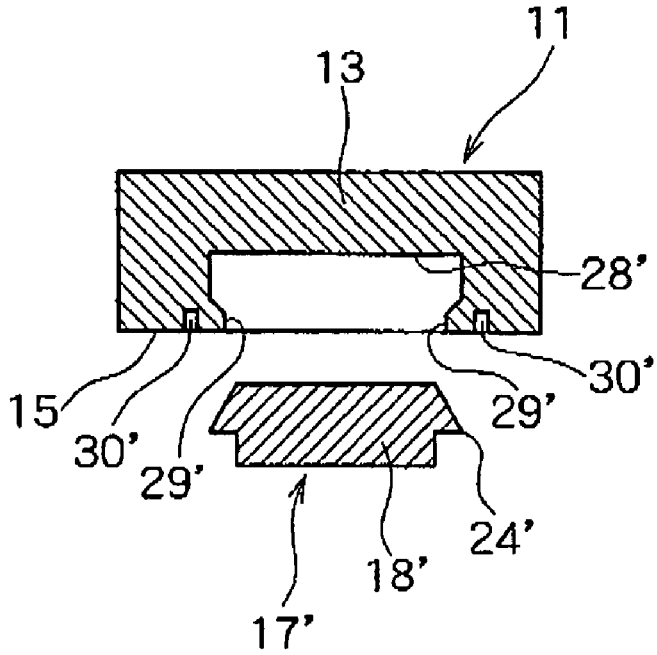
FIG. 13 is a cross-sectional view taken on line D—D of FIG. 11.

The shape of the second rotary plate 13 integrally formed with the lower end of the insert member 11 is such that the periphery of the second plate 13 fits to the peripheral wall 27 provided around the periphery of the first rotary plate 12 of the retaining member 10, in other words, the first and second rotary plates 12, 13 come into proper positions for mutual rotation upon each other, as shown in FIG. 7. As shown in FIGS. 11 and 13, the second rotary plate 13 is shaped like a circular plate to conform to the circular plate-like shape of the first rotary plate 12 of the retaining member 10. The second rotary plate 13 has a second circular recess 28' formed centrally on the second surface 15. The second rotary plate 13 has an inwardly-projecting peripheral rim 29' provided on the peripheral edge of the second circular recess 28' in order to facilitate snapping and retaining the second circular magnet 18' in the second circular recess 28'. The second rotary plate 13 also has an annular slit 30' formed on the second surface 15 outwardly and co-axially of the circular recess 28'. The second magnet 18' used for the insert member 11 is of the same shape as the first magnet 18 used for the retaining member 10 for commonage of parts. The way of using the retaining member 10 and insert member 11 in this embodiment are same as in the preceding embodiment.

Figure 14:
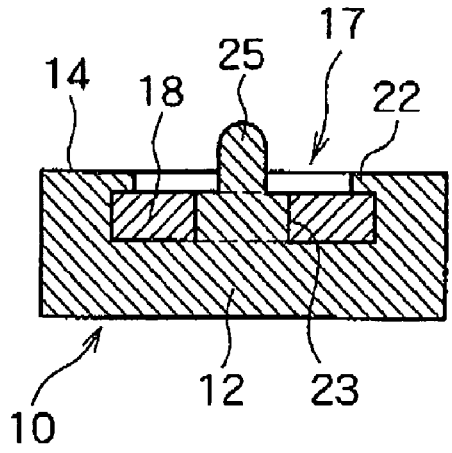
FIG. 14 is a cross-sectional view showing a magnet embedded in a rotary plate of a retaining member of a separable end stop according to the third embodiment of the present invention.
Figure 15:
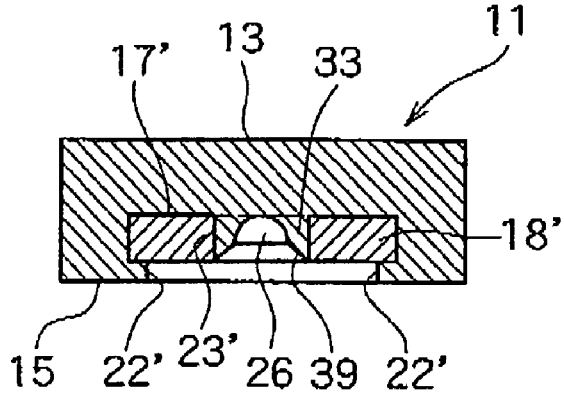
FIG. 15 is a cross-sectional view showing a magnet embedded in a rotary plate of an insert member of a separable end stop according to the third embodiment of the present invention.

FIGS. 14 and 15 show, as the third embodiment of the present invention, a modified way of providing the rotary plates 12, 13 with magnets 18, 18'. When the rotary plates 12, 13 are injection-molded, the magnets 18, 18' as magnetic elements 17, 17' are molded integrally into the rotary plates 12, 13.

As shown in FIG. 14, the first rotary plate 12 of the retaining member 10 has the projection 25 formed centrally thereof on the side of the first surface 14. The annular magnet 18 is embedded in the first rotary plate 12 around the projection 25 and is retained in stable manner by the sealing rim 22 formed over the periphery of the magnet 15.

As shown in FIG. 15, the second rotary plate 13 of the insert member 11 has a protuberant post 33 formed centrally thereof on the side of the second surface 15. The protuberant post 33 has a hole 26 formed in its upper end for fitting engagement with the projection 25 of the first rotary plate 12 of the retaining member 10. The protuberant post 33 has a chamfer 39 formed around the hole 26 to guide the projection 25 into fitting engagement with the hole 26. An annular magnet 18' is embedded in the rotary plate 13 around the protuberant post 33 and is retained in stable manner by the sealing rim 22' formed over the periphery of the magnet 18'.

Figure 16:
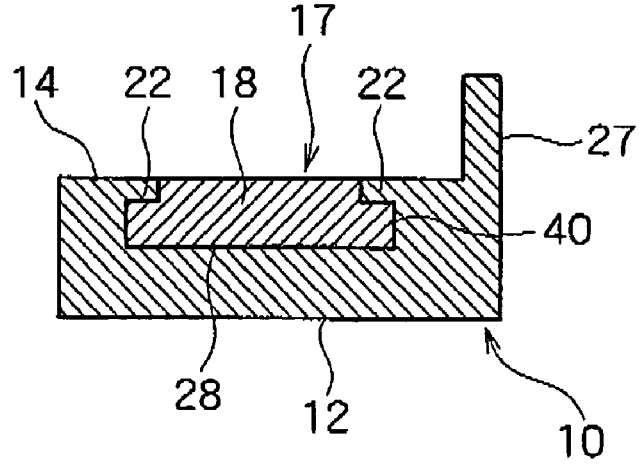
FIG. 16 is a cross-sectional view showing a magnet embedded in a rotary plate of a retaining member of a separable end stop according to the fourth embodiment of the present invention.
Figure 17:
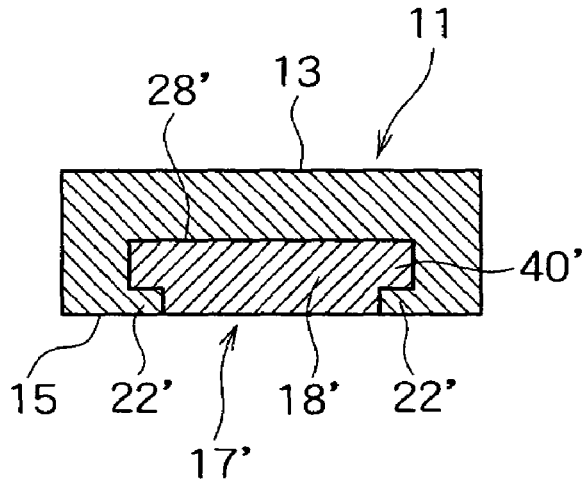
FIG. 17 is a cross-sectional view showing a magnet embedded in a rotary plate of an insert member of a separable end stop according to the fourth embodiment of the present invention.

FIGS. 16 and 17 show the fourth embodiment of the present invention. The fourth embodiment is substantially identical with the second embodiment shown in FIGS. 9 through 13, except that magnets 18, 18' are provided in the first and second rotary plates 12, 13 in a different way. Specifically, the first and second rotary plates 12, 13 shown in FIGS. 16 and 17 are of the type that the first rotary plate 12 of the retaining member 10 has a partly-cutoff peripheral wall 27 formed on the periphery thereof as in the second embodiment. According to this fourth embodiment, concurrently when the retaining member 10 and the insert member 11 are injection-molded, flattened magnets 18; 18' are embedded therein as magnetic elements 17, 17'. Specifically, in the injection-molding, a first magnet 18 having a protuberant flange 40 formed around its periphery is fixed firmly in the first rotary plate 12, with the protuberant flange 40 fully embedded in the rotary plate 12 and with the upper side of the first magnet 18 coplanar with the first surface 14. The periphery of the first magnet 18 is held in a stable manner in the first rotary plate 16 by a sealing rim 22.

As shown in FIG. 17, the second rotary plate 13 is made circular for fitting engagement with the peripheral wall 12 of the retaining member 10. Concurrently when the insert member 11 is injection-molded, a second magnet 18' having a protuberant flange 40' formed around its periphery is embedded into the second rotary plate 13 with the protuberant flange 40' fully embedded in the second rotary plate 12 and with the upper side of the magnet 18' coplanar with the surface 15. The periphery of the magnet 18' is held in a stable manner by a sealing rim 22'.

Figure 18:
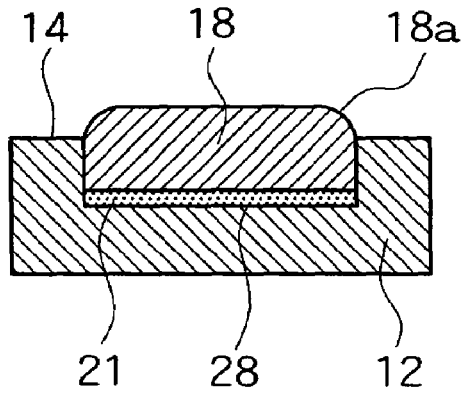
FIG. 18 is a cross-sectional view showing a magnet embedded in a rotary plate of a retaining member of a separable end stop according to the fifth embodiment of the present invention.
Figure 19:
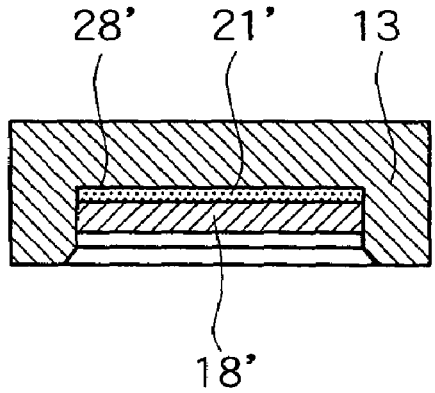
FIG. 19 is a cross-sectional view showing a magnet embedded in a rotary plate of an insert member of a separable end stop according to the fifth embodiment of the present invention.

FIGS. 18 and 19 show the fifth embodiment of the present invention. According to the fifth embodiment of the present invention, as shown in FIG. 18, the first magnet 18 is housed in the first recess 28 of the first rotary plate 12 of the retaining member 10 and bonded to its bottom by means of adhesive 21, with an upper part of the first magnet 18 projected beyond the first surface 14. Thus, the first magnet 18 is provided in the shape of a projection. The first magnet 18 is chamfered arcuately on the upper peripheral corner 18*a* thereof.

As shown in FIG. 19, the second magnet 18' is housed in the second recess 28' of the second rotary plate 13 of the insert member 11 and bonded to its bottom by means of adhesive 21', the upper side of the second magnet 18' falling short of the second surface 14. The peripheral rim of the second recess 28' is chamfered slantly. Thus, the second magnet 18' is provided in the shape of a hole. Since the first magnet 18 is provided in the shape of a projection and the second magnet 18' is provided in the shape of a hole, it is not necessary to form a separate projection and a separate hole in the first and second rotary plates 12, 13.

Figure 20:
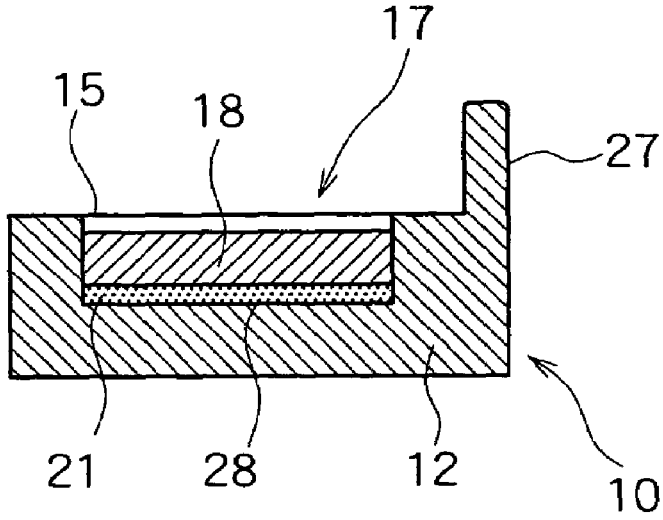
FIG. 20 is a cross-sectional view showing a magnet embedded in a rotary plate of a retaining member of a separable end stop according to the sixth embodiment of the present invention.

FIG. 20 shows the sixth embodiment of the present invention. The sixth embodiment is substantially identical with the second embodiment shown in FIGS. 9 through 13, except the way that the magnets 18, 18' are provided on the first and second rotary plate 12 13. As shown in FIG. 20, a circular magnet 18 is housed in the circular recess 28 and bonded to its bottom by means of synthetic adhesive 21 of resin or rubber.

Figure 21:
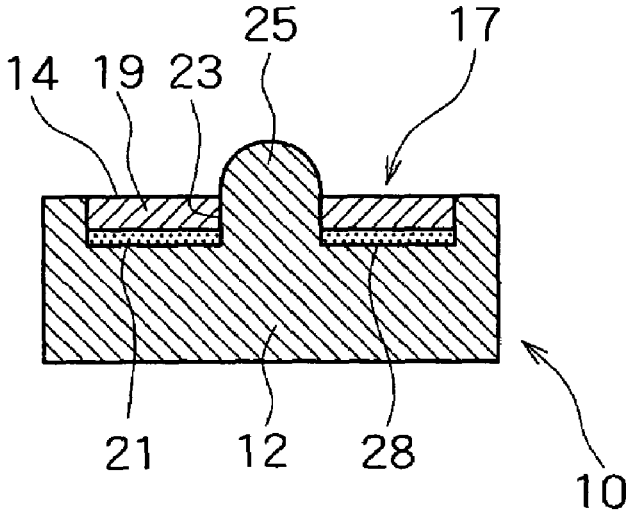
FIG. 21 is a cross-sectional view showing a magnetic sheet bonded to a rotary plate of a retaining member of a separable end stop according to the seventh embodiment of the present invention.

FIG. 21 shows the seventh embodiment of the present invention. According to the seventh embodiment, a first circular recess 28 is formed on the side of a first surface 14 of a first rotary plate 12. A projection 25 is mounted on the first rotary plate 12 centrally of the first circular recess 28 to project beyond the first surface 14. As a first magnetic element 17, an annular magnetic sheet 19 having a central aperture 23 centrally formed therethrough is cut out of a blank magnetic rubber sheet, etc. The annular magnetic sheet 19 is housed in the first recess 28 with the projection 25 passed through the central aperture 23 and bonded to its bottom by means of synthetic adhesive 21.

Figure 22:
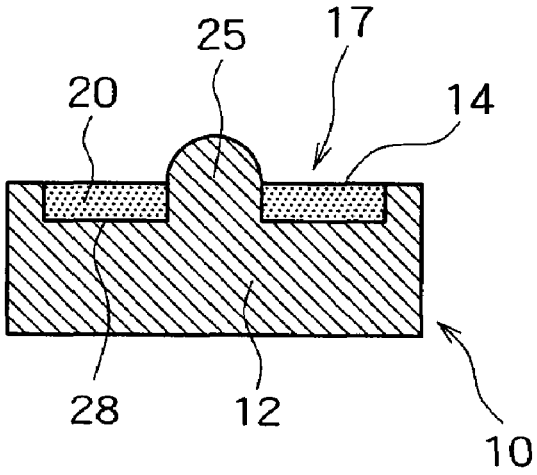
FIG. 22 is a cross-sectional view showing a magnetic paint or varnish applied to a rotary plate of a retaining member of a separable end stop according to the eighth embodiment of the present invention.

FIG. 22 shows the eighth modification of the present invention. According to the eighth embodiment, a circular recess 28 is formed on the side of a surface 14 of the rotary plate 12. A projection 25 is mounted centrally on the rotary plate 12 in the circular recess 28 to project beyond the surface 14. As magnetic element 17, magnetic paint or varnish 20 such as silicon varnish or epoxy varnish having magnetic powder blended therein are applied into the recess 28.

Figure 23:
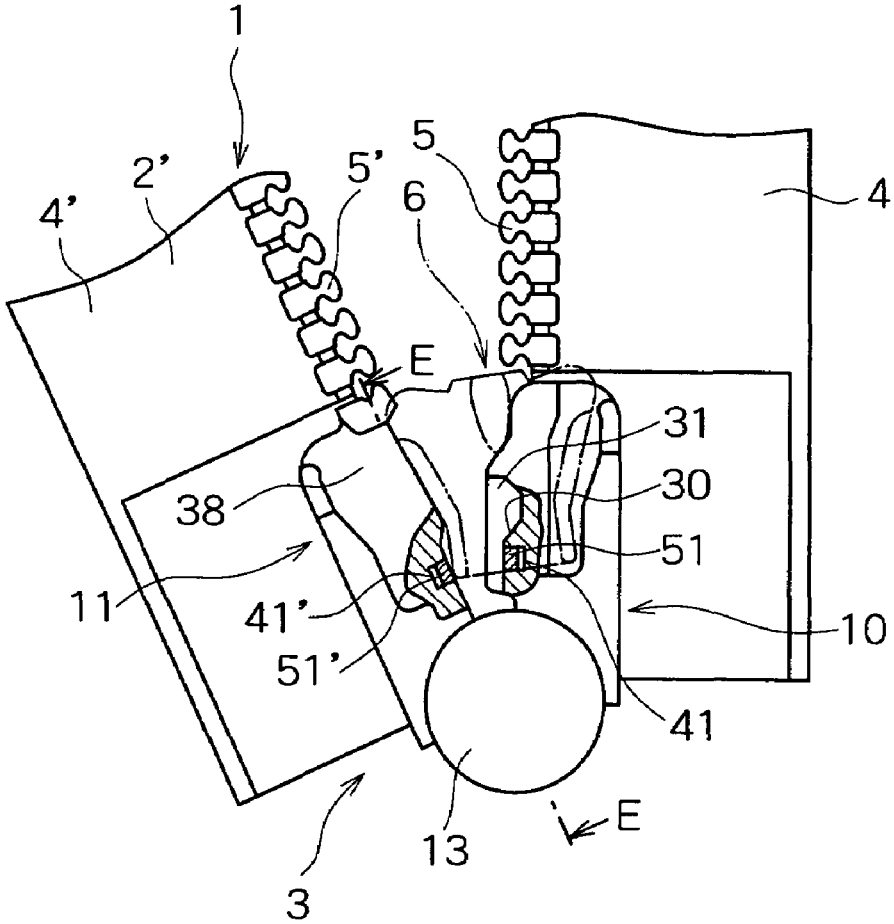
FIG. 23 is a fragmentary front view of a slide fastener with a separable end stop according to the ninth embodiment of the present invention, showing magnets provided on the confronting surfaces of a retaining member and an insert member.
Figure 24:
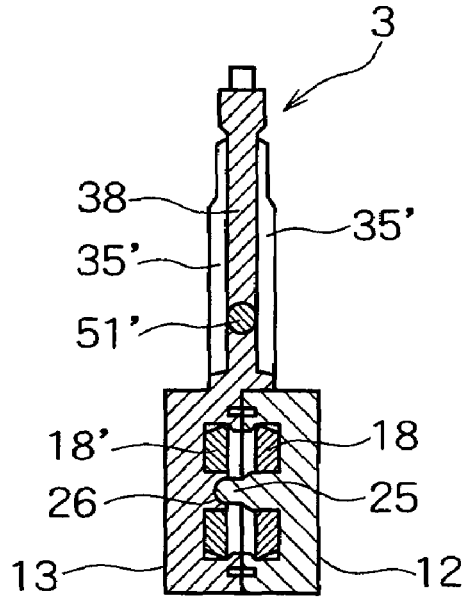
FIG. 24 is a cross-sectional view taken on line E—E of FIG. 23.
Figure 25:
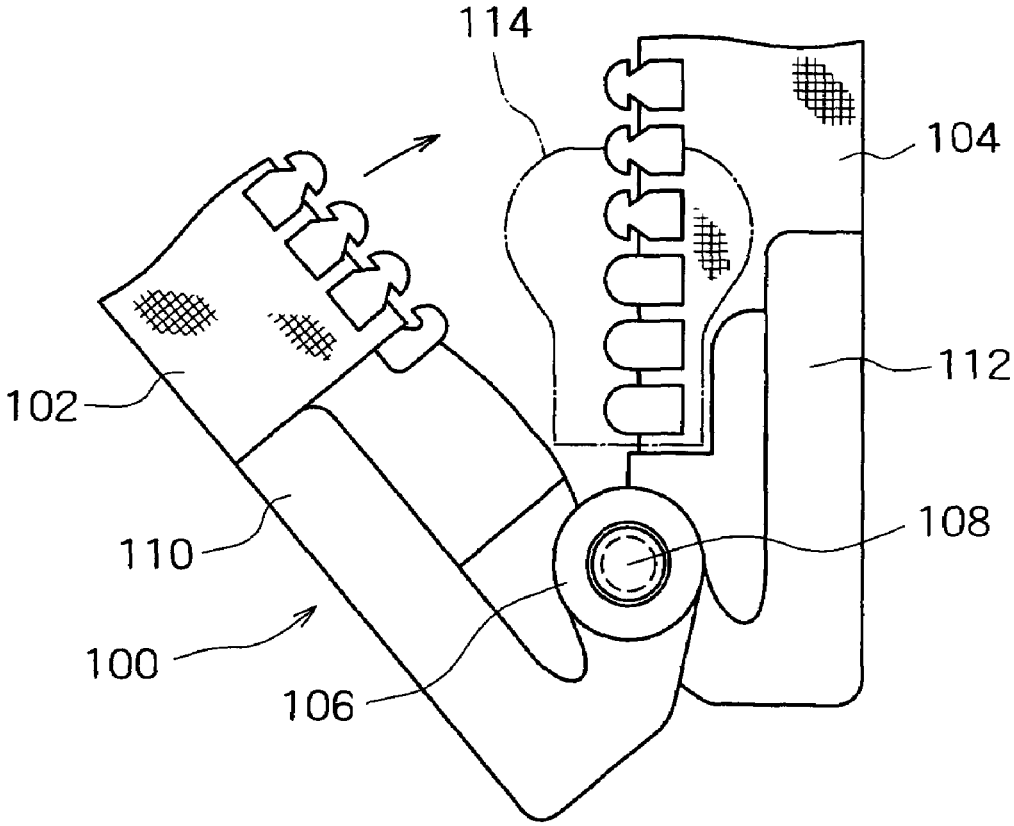
FIG. 25 is a fragmentary front view of a slide fastener with a well-known side-open type side-open type separable end stop.
Figure 26:
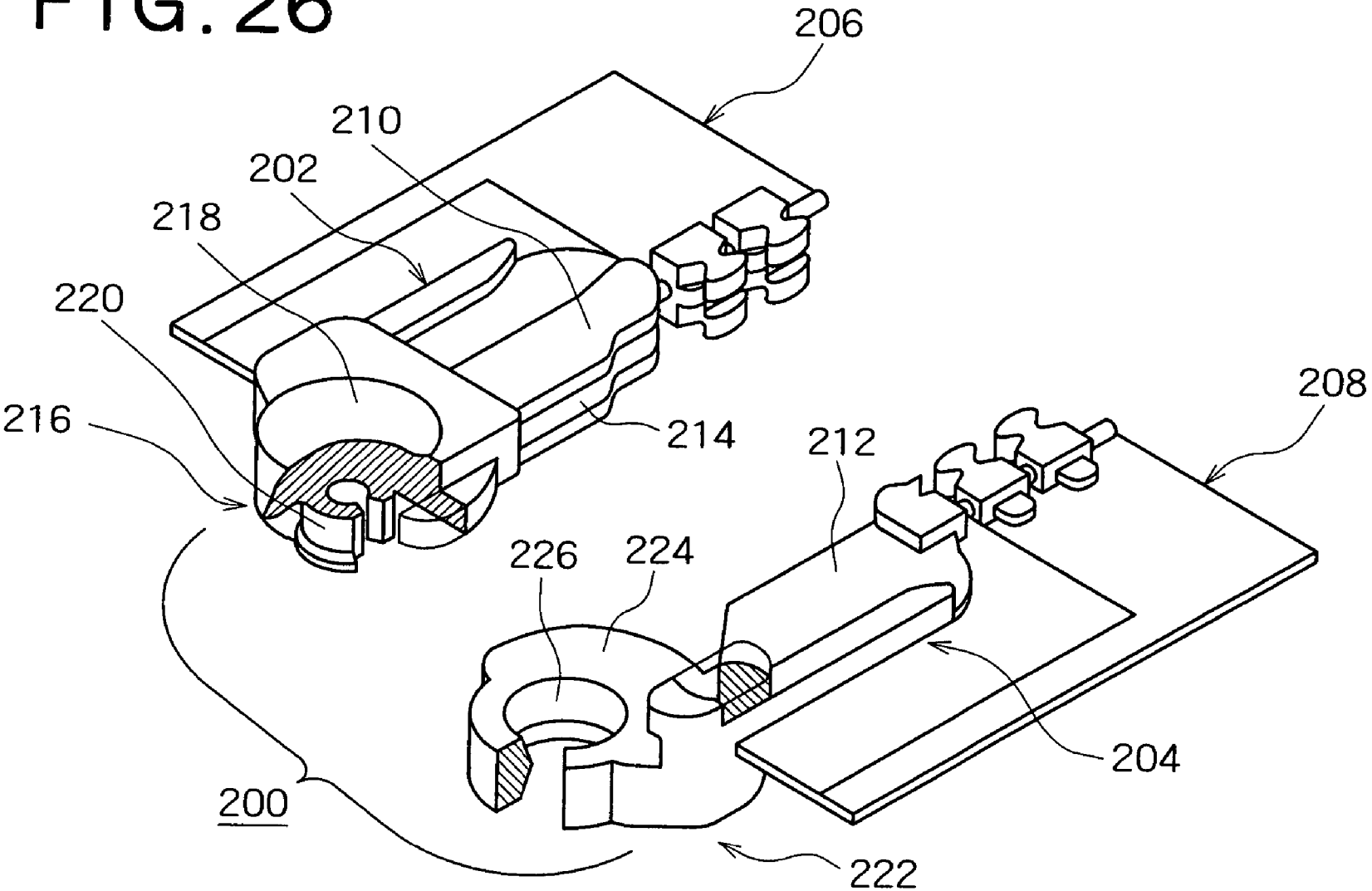
FIG. 26 is a fragmentary perspective view of a slide fastener with another well-known side-open type separable end stop.

FIGS. 23 and 24 show the ninth embodiment of the present invention. As shown in FIGS. 23 and 24, a separable end stop 3 according to the ninth embodiment is comprised of a retaining member 10 and an insert member 11 adapted to be inserted in the insertion slot 34. The retaining member 10 and the insert member 11 have the first and second rotary plates 12, 13 having the first and second surfaces 14, 15. The first and second surfaces 14, 15 of the first and second rotary plates 12, 13 have various types of magnetic elements 17, 17' described hereinabove applied thereto, so as to magnetically attract each other. The retaining member 12 and insert member 13 have cavities 41, 41' formed in their respective confronting surfaces adjacent to the rotary plates 12, 13; specifically in one surface in the slot 34 formed in the retaining bar 31 of the retaining member 10 and in the other confronting surface of the insert blade 38 of the insert member 11 which is insertable into the slot 34. As magnetic elements 17, 17', magnets 51, 51' are housed into and bonded to the cavities 41, 41' formed in the confronting surfaces of the retaining bar 31 and the confronting surface of the insert blade 38, respectively, by adhesive 21, 21' to thus mechanically bring the retaining bar 31 and the insert blade 38 toward each other in the general plane of the slide fastener 1.

The separable end stop 3 according to the ninth embodiment is operated as follows: In order to close a slide fastener chain 1 in open state, the rotary plates 12, 13 of the left and the right fastener stringers 2, 2' are brought closer perpendicularly of the general plane of the slide fastener 1. As the rotary plates 12, 13 approach each other, the magnets 51, 51' provided on the rotary plates 12, 13 attract the rotary plates 12, 13 toward each other so that the rotary plates 12, 13 has come into proper positions for mutual rotation on each other. Thereafter, the right and left fastener stringer 2, 2' are swung or angularly moved closer to each other, until the insert blade 38 of the insert member 11 of one fastener stringer 2 is inserted between opposed flanges of a slider 6 retained by the retaining bar 31 of the retaining member 10 of the other fastener stringer 2. Then, the magnets 51, 51' housed in the recesses 41, 41' provided on the confronting surfaces magnetically move the retaining member 10 and the insert member 11 toward each other in the general plate of the slide fastener 1, thus bringing them into abutting engagement with each other. Then, the slider 6 is pulled up to thus close the slide fastener.

In order to open the slide fastener 1 in closed state, the slider 6 is pulled down to the stop wall 37, 37' formed on the retaining member 10 and the insert member 11, respectively, of the separable end stop 3. Then, the retaining member 10 and the insert member 11 are swung upon each other to spread apart against the magnetic forces of the magnets 51, 51'. Thereafter, the rotary plates 12, 13 are separated from each other perpendicularly of the general plate of the slide fastener 1 against the magnetic forces of the magnets 18, 18', whereupon the slide fastener 1 is fully separated or open.

According to the present invention, not only the same type of magnetic elements 17, 17' but also different types of magnetic elements may be paired; that is, various pairs such as a magnet and a magnetic sheet, a magnet and magnetic paint or varnish, a magnetic sheet and magnetic paint or varnish, and even magnetic elements and iron can be used according to the present invention.

Conclusion, Ramifications, and Scope:

The separable end stop according to the present invention has a construction set forth hereinabove, and thus enjoys the following effects.

The retaining member and the insert member provided at the ends of the left and right fastener stringers magnetically attract each other to bring the two rotary plates into proper positions for mutual rotation upon each other so that even children and elderly people can manipulate the separable end stop with only one hand at great ease.

As magnetic elements, magnets are embedded into the rotary plates, magnets are press-fitted into the recesses formed in the rotary plates, the magnetic sheets are bonded to the rotary plates, or magnetic paint or varnish are applied to the rotary plates, or various combination of the above-listed magnetic elements are selected for use, so that simple forms of separable end stops can be made and the scope of the usage can be expanded widely.

While the above descriptions contain many specificities, these shall not be construed as limitations on the scope of the invention, but rather as exemplifications of embodiments thereof. Many other variations are possible. Accordingly, the scope of the invention should be determined not by the embodiments illustrated, but by the appended claims and the legal equivalents.

What is claimed is:

1. In a slide fastener comprising a pair of opposed fastener stringers and a slider reciprocally mounted on the fastener stringers to open and close them; a separable end stop comprising a retaining member and an insert member mounted on the lower ends of the fastener stringers and adapted to come into and out of engagement with each other in a plane of the slide fastener; the retaining member and insert member having first and second rotary plates integrally provided on their respective lower ends and adapted for mutual rotation upon each other to thus swing the retaining member and the insert member relative to each other; the rotary plates being formed in first and second surfaces with recesses; a projection being mounted centrally in either of the first and second recesses, while a protuberant post being provided centrally in the other recess and having a hole formed therein for fitting engagement with the projection; the first and second rotary plates having first and second annular magnets which have through apertures formed centrally therethrough, the first and the second annular magnets being fitted in the recesses with the projection and the post passing through the through apertures respectively for magnetically putting the rotary plates into proper positions for the mutual rotation upon each other, the rotary plates having inwardly-projecting rims formed on the respective peripheral edges of the recesses in order to retain the first and the second annular magnets within the recesses.

2. A separable end stop according to claim 1, wherein the projection projects outwardly beyond the top surfaces of the magnet and the first rotary plate; the hole is recessed beyond the front surfaces of the magnet and the rotary plate.

* * * * *